US008060996B2

(12) United States Patent
Rojdev et al.

(10) Patent No.: US 8,060,996 B2
(45) Date of Patent: Nov. 22, 2011

(54) SHEET METAL CASKET

(75) Inventors: Ilija Rojdev, Cincinnati, OH (US); Gregory Wray, Guilford, IN (US)

(73) Assignee: Batesville Services, Inc., Batesville, IN (US)

( * ) Notice: Subject to any disclaimer, the term of this patent is extended or adjusted under 35 U.S.C. 154(b) by 259 days.

(21) Appl. No.: 12/433,543

(22) Filed: Apr. 30, 2009

(65) Prior Publication Data

US 2010/0275422 A1 Nov. 4, 2010

(51) Int. Cl.
*A61G 17/00* (2006.01)

(52) U.S. Cl. ..... 27/6; 27/3

(58) Field of Classification Search ..... 27/2, 3, 27/6, 19; 220/62.16, 62.17, 62.11, 917; 428/615, 428/618, 671, 674, 685, 924, 925
See application file for complete search history.

(56) References Cited

U.S. PATENT DOCUMENTS

| | | | | |
|---|---|---|---|---|
| 1,171,069 | A | 2/1916 | Schmidt | |
| 1,433,443 | A * | 10/1922 | Wilson | 27/6 |
| 2,009,606 | A * | 7/1935 | Diffenderfer | 220/565 |
| 2,214,889 | A * | 9/1940 | Purkiss | 27/5 |
| 2,471,663 | A * | 5/1949 | Tietz | 228/155 |
| 3,052,946 | A | 9/1962 | Hillenbrand | |
| 4,523,358 | A * | 6/1985 | Semon | 27/6 |
| 4,564,001 | A * | 1/1986 | Maeda | 219/621 |
| 5,376,464 | A * | 12/1994 | Dupoiron et al. | 428/679 |
| 5,467,884 | A * | 11/1995 | Schutz | 220/1.5 |
| 5,475,902 | A | 12/1995 | Rogers et al. | |
| 5,636,419 | A * | 6/1997 | Foye | 27/19 |
| 6,029,326 | A * | 2/2000 | Semon | 27/10 |
| 6,316,128 | B1 | 11/2001 | Ishio | |
| 6,591,466 | B1 * | 7/2003 | Acton et al. | 27/10 |
| 6,623,690 | B1 * | 9/2003 | Rizzo et al. | 419/6 |
| 2007/0101559 | A1 * | 5/2007 | Poteet | 27/6 |

OTHER PUBLICATIONS

Robert Baboian, Corrosion of Clad Metals, adapted from R. Baboian and G. Haynes, Corrosion of Clad Metals, Corrosion, vol. 13, ASM Handbook, ASM International, 1987, pp. 887-890.

* cited by examiner

*Primary Examiner* — William L. Miller
(74) *Attorney, Agent, or Firm* — Wood, Herron & Evans, LLP

(57) ABSTRACT

A sheet metal casket comprises a casket shell having a pair of side walls, a pair of end walls, and a bottom wall, and a casket cap closable on the casket shell. At least a portion of at least one of the shell and cap are fabricated of clad sheet metal formed from first and second different metals.

17 Claims, 1 Drawing Sheet

SHEET METAL CASKET

RELATED APPLICATIONS

None.

FIELD

This relates generally to caskets and more particularly to materials from which to manufacture sheet metal caskets.

BACKGROUND

Currently sheet metal caskets are constructed from various metals such as carbon steel, stainless steel, copper and bronze.

Steel caskets have heretofore been provided with protection against corrosion by electrically connecting a sacrificial anode made of zinc or magnesium to the casket, whereby the casket becomes the cathode of an electrolytic cell in the presence of ground water. Examples of such cathodic protection are disclosed in U.S. Pat. Nos. 5,475,902 and 3,052,946, hereby incorporated by reference herein.

It is desirable to provide steel caskets with protection against corrosion without incurring the material and labor costs associated with fabricating and installing a sacrificial anode of the type shown in the '902 and '946 patents.

Precious metal caskets such as those fabricated from copper and bronze can be more expensive than steel caskets because of the price of the raw material. Also, because the stiffness and strength mechanical properties of the various steels are typically greater than those of the various precious metals, the wall thickness of a precious metal casket may have to be thicker than that of a comparable steel casket in order to provide the necessary stiffness and strength, further exacerbating the cost differential between a typical steel casket and a typical precious metal casket.

It is desirable to provide a precious metal casket at a lower price yet which does not compromise the stiffness and strength of the casket.

SUMMARY

In one aspect, a sheet metal casket comprises a casket shell having a pair of side walls, a pair of end walls, and a bottom wall, and a casket cap closable on the casket shell. At least a portion of at least one of the shell and cap are fabricated of clad sheet metal formed from first and second different metals.

Examples of the first metal are carbon steel and stainless steel. Examples of the second metal are copper, bronze, magnesium and zinc. The second metal can be clad on only one side of the first metal, or on both sides of the first metal. When the first metal is chosen to be carbon steel and the second metal is chosen to be copper, and the copper is clad on only one side of the carbon steel, one example of suitable relative thicknesses of the carbon steel and the copper is the copper having a thickness of about 10% of the combined thickness of the carbon steel and copper.

In another aspect, a sheet metal casket comprises a casket shell having a pair of side walls, a pair of end walls, and a bottom wall, and a casket cap closable on the casket shell. At least a portion of the bottom wall of the shell is fabricated of clad sheet metal formed from first and second different metals, and at least a portion of at least one of the balance of the shell and the cap are fabricated of clad sheet metal formed from the first metal and a third different metal.

Examples of the first metal are carbon steel and stainless steel. Examples of the second metal are magnesium and zinc. Examples of the third metal are copper and bronze. The third metal can be clad on only one side of the first metal, or on both sides of the first metal. When the first metal is chosen to be carbon steel and the third metal is chosen to be copper, and the copper is clad on only one side of the carbon steel, one example of suitable relative thicknesses of the carbon steel and the copper is the copper having a thickness of about 10% of the combined thickness of the carbon steel and copper.

The shell can include hardware, for example handle bars, handle bar arms, escutcheon plates and corner ornaments, also fabricated of clad sheet metal.

DRAWINGS

DESCRIPTION

Figure 1:
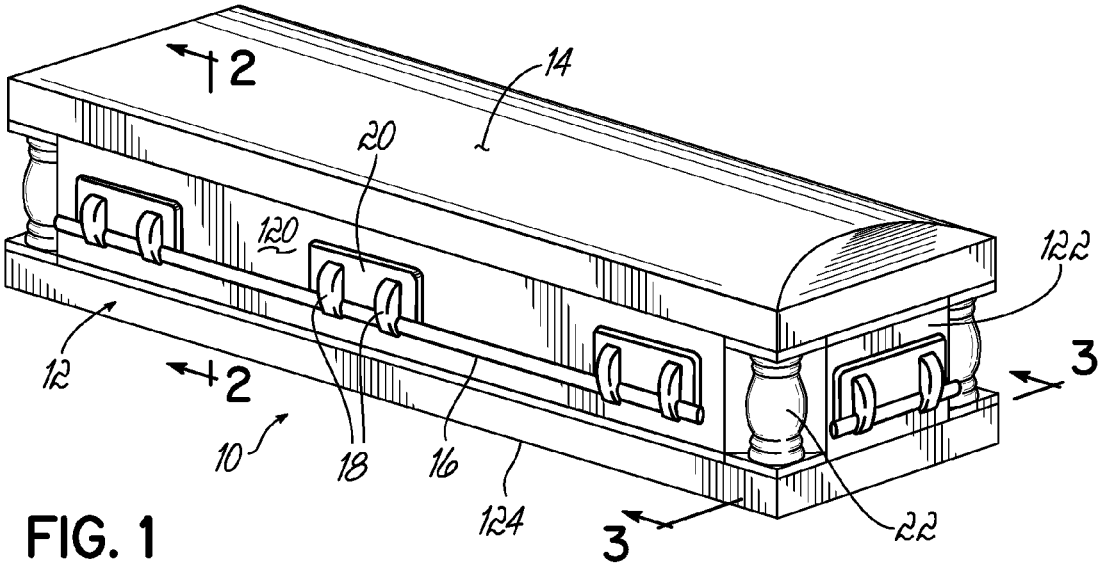
FIG. 1 is a perspective view of a sheet metal casket.

Referring to FIG. 1, a sheet metal casket 10 has a sheet metal casket shell 12 adapted to receive a deceased and a sheet metal casket cap 14 closable on the shell 12. The shell 12 has a pair of side walls 120, a pair of end walls 122, and a bottom wall or floor 124. The casket 10 may further include hardware such as handle bar 16, attachment arms 18 for attaching bar 16 to shell 12, escutcheon plates 20 for covering the attachment point of arms 18 to shell 12, and corner ornaments 22.

Figure 2:
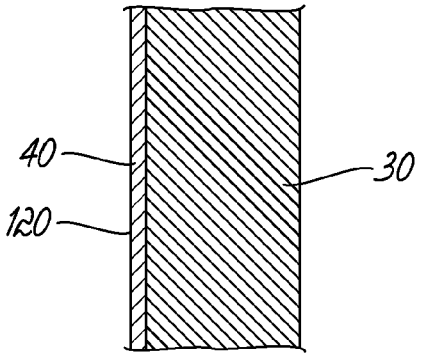
FIGS. 2 and 2A are views generally taken along line 2-2 of FIG. 1.
Figure 3:
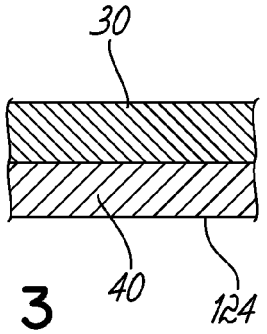
FIG. 3 is a view generally taken along line 3-3 of FIG. 1.
Figure 2A:
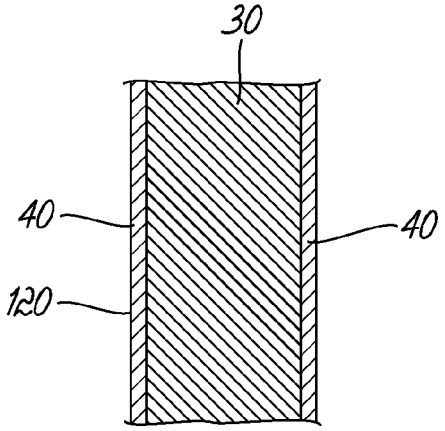

FIGS. 2 and 2A illustrate a construction which provides the "best of both worlds" of steel caskets and precious metal caskets. More particularly, these figures illustrate a clad sheet metal construction in which first and second metals 30, 40 are clad together. The casket 10 is then fabricated from the resulting clad sheet metal. As used herein, "clad metal" means a composite metal containing two or more different metals that have been bonded together by one of a number of techniques, such as, for example, cold roll bonding, hot roll bonding, hot pressing, explosion bonding, extrusion bonding, and plating, to bring the metal surfaces into intimate contact, promote diffusion between the metals, and result in a permanent metallurgical bond between the metals to form a single material.

Either or both of the shell 12 and cap 14, or any portion of either, can be fabricated of clad sheet metal formed from first and second different metals 30, 40. For that matter, any of the hardware to include handle bar 16, attachment arms 18 for attaching bar 16 to shell 12, escutcheon plates 20 for covering the attachment point of arms 18 to shell 12, and corner ornaments 22 can be fabricated in whole or in part of clad sheet metal formed from first and second different metals 30, 40. Examples of the first metal are carbon steel and stainless steel. Examples of the second metal are copper and bronze. The second metal can be clad on only one side of the first metal, or on both sides of the first metal (FIG. 2A). When the first metal is chosen to be carbon steel and the second metal is chosen to be copper, and the copper is clad on only one side of the carbon steel, one example of suitable relative thicknesses of the carbon steel and the copper is the copper having a thickness of about 10% of the combined thickness of the carbon steel and copper.

In the case where it is desirable to eliminate the sacrificial anode rod or bar of U.S. Pat. Nos. 5,475,902 and 3,052,946, yet still provide a measure of cathodic protection for the steel casket, the second metal can be zinc or magnesium (for pairing with the first metal of carbon steel or stainless steel) for the bottom wall 124 or floor of the casket shell 12 or a portion of the bottom wall 124, for example a strip. Such a construction eliminates the material and labor costs associated with fabricating and installing a separate sacrificial anode rod or bar while providing the same or similar cathodic protection. The balance of the shell 12 (i.e. side walls and end walls) and the cap 14 can be fabricated of clad sheet metal formed from the first metal, for example carbon steel or stainless steel mentioned above, and a third different metal, for example copper or bronze mentioned above.

The embodiments shown and described are merely for illustrative purposes only. The drawings and the description are not intended to limit in any way the scope of the claims. Those skilled in the art will appreciate various changes, modifications, and other embodiments. All such changes, modifications and embodiments are deemed to be embraced by the claims. For examples, other metals other than those specifically mentioned can be used. And, the clad metal can be formed from two or more different metals. Accordingly, the scope of the right to exclude shall be limited only by the following claims and their equivalents.

What is claimed is:

1. A sheet metal casket comprising:

a casket shell having a pair of side walls, a pair of end walls, and a bottom wall, and a casket cap closable on said casket shell, at least a portion of said bottom wall of said shell fabricated of clad sheet metal formed from first and second different metals, said at least a portion of said bottom wall functioning as a cathodic protection system, wherein one of said first and second metals functions as a cathode of an electrolytic cell, and the other of said first and second metals functions as a sacrificial anode of said electrolytic cell;

at least a portion of at least one of the balance of said shell and said cap fabricated of clad sheet metal formed from said first metal and a third different metal.

2. The casket of claim 1 wherein said first metal is chosen from the group consisting of carbon steel and stainless steel, said second metal is chosen from the group consisting of magnesium and zinc, and said third metal is chosen from the group consisting of copper and bronze.

3. The casket of claim 1 wherein said third metal is clad on only one side of said first metal.

4. The casket of claim 2 wherein said first metal is carbon steel and said third metal is copper, and wherein a thickness of said copper is about 10% of a combined thickness of said carbon steel and said copper.

5. The casket of claim 1 wherein said third metal is clad on both sides of said first metal.

6. The casket of claim 1 wherein said shell includes hardware fabricated of clad sheet metal.

7. The casket of claim 6 wherein said hardware comprises a handle bar, handle bar arms, escutcheon plates and corner ornaments.

8. A sheet metal casket comprising:

a casket shell having a pair of side walls, a pair of end walls, and a bottom wall, and a casket cap closable on said casket shell, said bottom wall of said shell fabricated of clad sheet metal formed from first and second different metals which have been permanently metallurgically bonded together, said bottom wall functioning as a cathodic protection system, wherein one of said first and second metals functions as a cathode of an electrolytic cell, and the other of said first and second metals functions as a sacrificial anode of said electrolytic cell;

the balance of said shell and said cap fabricated of clad sheet metal formed from said first metal and a third different metal which have been permanently metallurgically bonded together.

9. The casket of claim 8 wherein said first metal is chosen from the group consisting of carbon steel and stainless steel, said second metal is chosen from the group consisting of magnesium and zinc, and said third metal is chosen from the group consisting of copper and bronze.

10. A sheet metal casket comprising:

a casket shell having a pair of side walls, a pair of end walls, and a bottom wall, and a casket cap closable on said casket shell, at least a portion of only said bottom wall of said shell functioning as a cathodic protection system, said at least a portion of said bottom wall fabricated of clad sheet metal formed from first and second different metals, said first metal functioning as a cathode of an electrolytic cell and said second metal functioning as a sacrificial anode of said electrolytic cell.

11. The casket of claim 10 wherein said first metal is chosen from the group consisting of carbon steel and stainless steel, and wherein said second metal is chosen from the group consisting of magnesium and zinc.

12. The casket of claim 11 wherein said casket shell side walls and end walls are fabricated of said first metal.

13. The casket of claim 12 wherein said casket cap is fabricated of said first metal.

14. The casket of claim 11 wherein said casket shell side walls and end walls are fabricated of clad sheet metal formed from said first metal and a third different metal.

15. The casket of claim 14 wherein said third metal is chosen from the group consisting of copper and bronze.

16. The casket of claim 15 wherein said casket cap is fabricated of said clad sheet metal formed from said first and said third different metals.

17. The casket of claim 10 wherein substantially all of said bottom wall of said casket shell is fabricated of said clad sheet metal formed from said first and second different metals.

* * * * *